US009045279B2

(12) United States Patent
Eggemeyer

(10) Patent No.: US 9,045,279 B2
(45) Date of Patent: Jun. 2, 2015

(54) SYSTEMS AND METHODS FOR REDUCING VAPOR EMISSION FROM FLOATING ROOF STORAGE VESSELS

(71) Applicant: Kinder Morgan Operating L.P. "C", Houston, TX (US)

(72) Inventor: Wayne Eggemeyer, Nuremberg, PA (US)

(73) Assignee: Kinder Morgan Operating LP C, Houston, TX (US)

( * ) Notice: Subject to any disclaimer, the term of this patent is extended or adjusted under 35 U.S.C. 154(b) by 0 days.

(21) Appl. No.: 13/847,847

(22) Filed: Mar. 20, 2013

(65) Prior Publication Data

US 2014/0190967 A1 Jul. 10, 2014

Related U.S. Application Data

(60) Provisional application No. 61/613,399, filed on Mar. 20, 2012.

(51) Int. Cl.

| | |
|---|---|
| ***B65D 88/38*** | (2006.01) |
| ***B65D 88/42*** | (2006.01) |
| ***B65D 88/40*** | (2006.01) |
| ***B65D 90/28*** | (2006.01) |

(52) U.S. Cl.
CPC ..... *B65D 88/42* (2013.01); *B65D 88/40* (2013.01); *B65D 90/28* (2013.01)

(58) Field of Classification Search
CPC ..... B65D 88/42; B65D 88/40; B65D 90/28; B65D 88/46; B65D 88/34
USPC ..... 220/216, 227, 202, 366.1, 367.1, 567.2, 220/567, 560; 137/171
See application file for complete search history.

(56) References Cited

U.S. PATENT DOCUMENTS

| | | | | |
|---|---|---|---|---|
| 2,542,444 | A * | 2/1951 | Wilkin | 220/224 |
| 3,474,931 | A * | 10/1969 | Wilkin | 220/219 |
| 4,099,644 | A * | 7/1978 | Nuttall et al. | 220/225 |
| 4,426,233 | A * | 1/1984 | Manabe et al. | 134/21 |
| 4,529,007 | A | 7/1985 | Goforth | |
| 5,351,885 | A * | 10/1994 | Manabe | 239/73 |
| 5,353,941 | A * | 10/1994 | Benvegnu et al. | 220/220 |
| 6,035,898 | A | 3/2000 | Dominguez | |
| 2007/0272692 | A1 * | 11/2007 | Hiner | 220/219 |
| 2010/0258561 | A1 * | 10/2010 | Farraj Al-Farraj | 220/219 |
| 2012/0152950 | A1 * | 6/2012 | Al-Subaiey | 220/219 |

OTHER PUBLICATIONS

Mar. 26, 2014 Canadian Office Action.

* cited by examiner

*Primary Examiner* — Robert J Hicks
*Assistant Examiner* — Kareen Rush
(74) *Attorney, Agent, or Firm* — Robert W Strozier

(57) ABSTRACT

Floating roof storage vessels including a vapor emission reduction system designed to be inserted into deck leg apertures, when the legs have been removed during hydrocarbon storage.

16 Claims, 4 Drawing Sheets

SYSTEMS AND METHODS FOR REDUCING VAPOR EMISSION FROM FLOATING ROOF STORAGE VESSELS

RELATED APPLICATIONS

This application claims the benefit of and priority to U.S. Provisional Patent Application Ser. No. 61/613,399 filed Mar. 20, 2012 (20 Mar. 2012).

BACKGROUND OF THE INVENTION

1. Field of the Invention

Embodiments of the present invention relate to systems and methods for reducing vapor emission from deck leg apertures of floating roof storage vessels.

More particularly, embodiments of the present invention relate to systems and methods for reducing vapor emission from deck leg apertures of floating roof storage vessels, where the vessels include a deck leg aperture vapor reduction system.

2. Description of the Related Art

A large number of petroleum above ground storage tanks (AST's) were built prior to 1980 and prior to the EPA more stringent regulations regarding hydrocarbon vapor emission control. The latest emission control standards require the use of the best available control technology (BACT) to minimize the vapor emissions. The new standards have required companies with older storage tanks to find practical ways to retrofit existing tanks to achieve compliance.

The purpose of a leg sleeve on an internal floating roof (IFR) storage tanks is to allow for the insertion of pipe legs in order to support the floating roof during maintenance activities. Normal out of service maintenance of the tank bottom is performed in the high leg position to allow safe entry under the roof. When the tank is returned to service the pipe legs are removed from the sleeves and placed on the floating roof until the next out of service maintenance is required. The remaining leg sleeve penetration in the roof is where vapor emissions can occur. In an effort to minimize the cost of taking tanks out of service and modifying each leg sleeve, most AST owners have adopted the simple approach of installing an impermeable bag or leg sock over the leg sleeve to minimize vapor emissions.

The existing technology is able to achieve compliance; however, the devices are not as effective as the vapor plug design and are difficult to maintain. In some cases these bags or socks do not seal well around the leg sleeve and rip or tear from the installation process and material fatigue. These rips or tears in the bags or socks can be found during required inspections and can result in owners receiving Notice of Violation (NOV) from the governing Air District. These fines can carry stiff penalties in some cases.

New technology is typically presented to the local Air Pollution Control District Agency, and after documented testing is confirmed, the Agency may consider it to be BACT and even establish a lower emission factor for the technology compared to other devices. A lower emission factor would create potential savings when purchasing emission credits for future processing and storage of petroleum products.

SUMMARY OF THE INVENTION

Embodiments of this invention provide emission control systems for floating roof storage tanks having a plurality leg sleeves, where the emission control systems include vapor emission control apparatuses inserted into the leg sleeves.

The vapor emission control apparatuses include a compressible member that when compressed forms an air tight or substantially air tight seal against an inner surface of the leg sleeves, where the seal is positioned below leg pin apertures that lock the legs in place during tank maintenance The emission control systems of this invention are designed to reduce, substantially eliminate or completely eliminate VOC emission from the leg sleeves.

Embodiments of this invention provide emission control methods including providing a floating roof storage tank having a plurality leg sleeves and inserting a plurality of vapor emission control apparatuses of an emission control system of this invention into the leg sleeves, and forming an air tight seal or a substantially air tight seal between compressible members associated with the vapor emission control apparatuses below leg pin apertures in the leg sleeve, where the vapor emission control apparatuses reduce, substantially eliminate or completely eliminate VOC emission from the leg sleeves.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
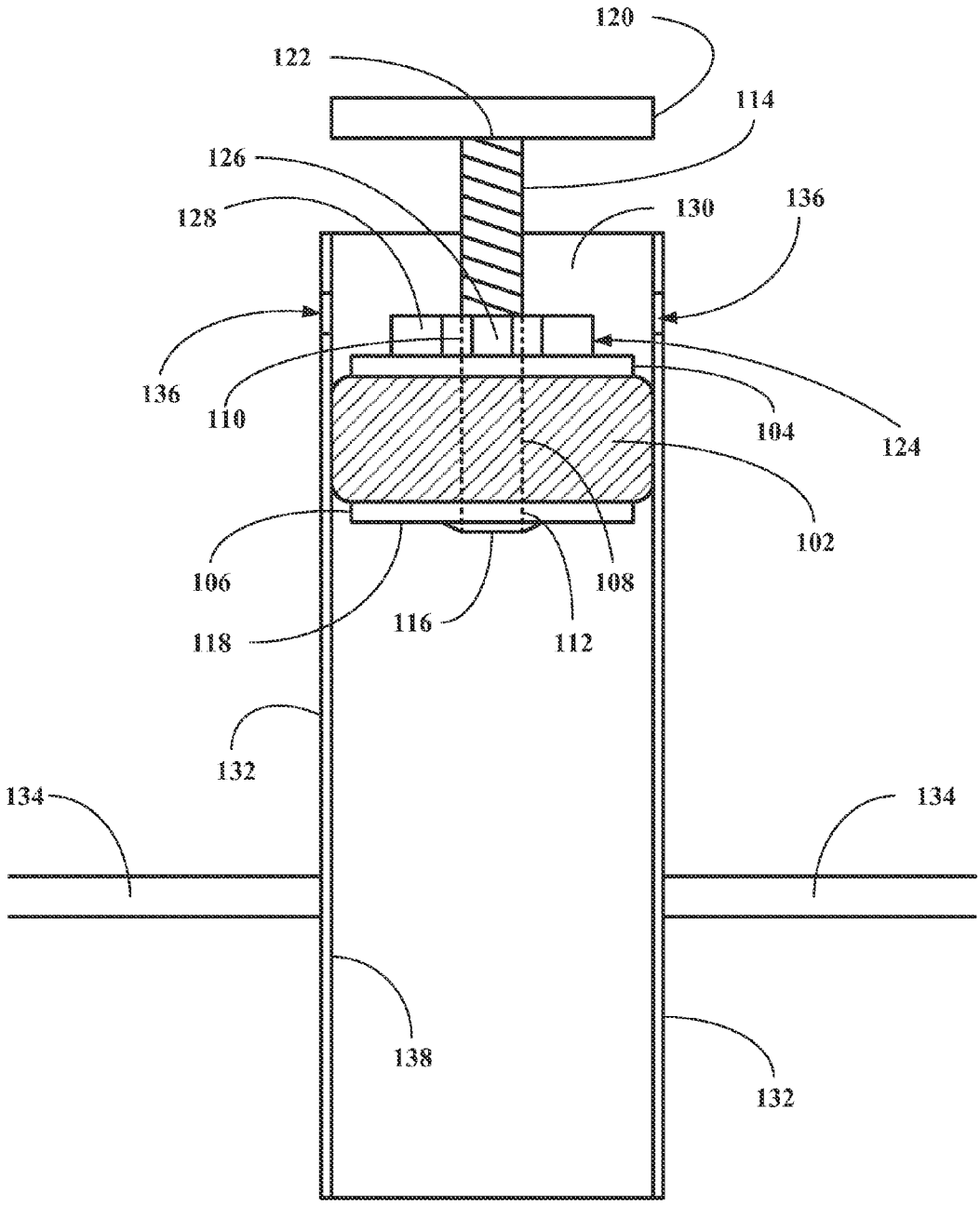
FIG. 1 depicts an embodiment a vapor emission control apparatus of this invention.

The inventor has found that emission control systems may be designed for floating roof (FR) storage tanks having a plurality leg sleeves, where the emission control system includes a plurality of vapor emission control apparatuses inserted into the top end of the leg sleeves, where the apparatuses include a compressible member designed to form an air tight or substantially air tight seal with an inner surface of the leg sleeves below the leg pin apertures of the leg sleeves. The inventor has also found that methods may be implemented using the emission control system for floating roof storage tanks. The methods include inserting a plurality of vapor emission control apparatuses of an emission control system of this invention into the top end of the leg sleeves associated with a floating roof storage tank and compressing the compressible members to form an air tight or substantially air tight seal with an inner surface of the leg sleeves below the leg pin apertures of the leg sleeves. The vapor emission control apparatuses are designed to reduce, substantially eliminate, or eliminate vapor emissions from the leg sleeves. The emission control systems of this invention are ideally suited for internal floating roof (IFR) storage tanks and open floating roof storage tanks.

The vapor emission control systems of this invention have a number of benefits (1) the systems reduce vapor emissions for FR, IFR or open floating roof storage tanks; (2) the systems are likely to be classified by agencies as having a lower emission factor compared to current technology resulting in cost savings for emission credits; (3) the systems are easy to maintain; and (4) the systems reduce the likelihood of permit violations.

Embodiments of this invention broadly relate to emission control systems for floating roof storage tanks having a plurality leg sleeves, where the emission control systems include vapor emission control apparatuses inserted into the top end of leg sleeves associated with a floating roof storage tanks, where the apparatuses include a compressible member designed to form an air tight or substantially air tight seal with an inner surface of the leg sleeves below the leg pin apertures of the leg sleeves. The vapor emission control apparatuses are designed to reduce, substantially eliminate, or completely eliminate VOC emission from the leg sleeves. The vapor emission control apparatuses include a compressible member interposed between a top compression plate and a bottom compression plate. The compression or compressible member includes an aperture therethrough as do the plates. The apparatuses also include a threaded shaft inserted through the member and the plates. The shaft includes a head designed to engage a bottom surface of the bottom plate and a handle for rotating the threaded shaft at its tail end. The apparatuses also include a top, which is designed to rest on a top end of a leg sleeve of a floating roof of a floating roof storage tank. The apparatuses also include a locking assembly such as a nut with wings (a wing nut), two or more nuts, or other locking assemblies. The apparatuses also include a spacer interposed between the top and the locking member. The apparatuses also include a spacer tube interposed between the top and the top plate. The apparatuses are inserted into the leg sleeve so that the compressible member is situated below leg pin apertures in the leg sleeves and the seal is formed below the apertures.

The apparatuses operate as follows. When the handle is turned one way, the plates move apart permitting the compressible member to relax so that the apparatus can be removed from the leg sleeve. When the handle is turned the other way, the plates move closer together compressing the compressible member to form a vapor tight or substantially vapor tight seal against the sleeve inner wall.

Embodiments of this invention broadly relate to emission control methods including providing a floating roof storage tank having a plurality leg sleeves and inserting a plurality of vapor emission control apparatuses of an emission control system of this invention into the leg sleeves, where the vapor emission control apparatuses reduce, substantially eliminate or completely eliminate VOC emission from the leg sleeves.

The term "substantially" mean in relationship to air tight seals that the seal prevents at least 95% of VOCs from venting through the seal. In other embodiments, the term means that the seal prevents at least 97.5% of the VOCs from venting through the seal. In other embodiments, the term means that the seal prevents at least 99.5% of the VOCs from venting through the seal. In other embodiments, the term means that the seal prevents at least 99.9% of the VOCs from venting through the seal.

SUITABLE REAGENTS FOR USE IN THE INVENTION

Suitable materials out of which the compressible member may be made include, without limitation, any rubber, cured or uncured, but preferably cured. Suitable rubbers for uses in the compressible members include, without limitation, butyl rubber, nitrile rubber (NBR), EPDM, styrene-butadiene rubber (SBR), styrene-isoprene rubber (SIR), styrene-butadiene-isoprene rubber (SBIR), silicon rubbers, polyurethane rubbers, fluorosilicon rubber, perfluoroelastomers, other types of rubbers, or mixtures or combinations thereof. The rubbers, which are made up of two or more monomers, may be random or blocked rubbers, may be hydrogenated, or treated in other ways. The rubbers may be compounded with fillers including, without limitation, carbon blacks, silicas, clays, other fillers, and mixtures or combinations thereof. The rubbers may also be compounded with antioxidiants and antiozoants, other stabilizing materials or mixtures or combinations thereof. The rubbers may also be and preferably are cured, where the curing may be sulfur based, peroxide based, radiation based, other curing or mixtures or combinations thereof, depending on the type of rubber compound out of which the compressible member is made. Due to the presence of VOCs, the preferred rubbers are rubber resistance to VOCs including, without limitation, nitrile rubber (NBR), Viton, polyurethane, fluorosilicone, tetrafluoroethylene-propylene copolymers (TFE/P), such as AFLAS®, a registered trademark of AGC Chemicals Americas, Inc., perfluoroelastomers such as KALREZ®, a registered trademark of DuPont, and mixtures or combinations thereof.

DETAIED DESCRIPTION OF THE DRAWINGS

Referring now to FIG. 1, a simple embodiment of a vapor emission control apparatus for leg sleeves of a floating roof storage tank, generally 100, is shown to include a compressible member 102 interposed between a top compression plate 104 and a bottom compression plate 106. The compression member 102 includes an aperture 108 therethrough; the top plate 104 includes an aperture 110, therethrough; and the bottom plate 106 includes an aperture 112, therethrough. The three apertures 108, 110, and 112 are designed to align. The apparatus 100 includes a threaded shaft 114 inserted through the apertures 108, 110, and 112 in the member 102 and the plates 104 and 106, respectively. The shaft 114 includes a head end 116 designed to engage a bottom surface 118 of the bottom plate 106. Of course, the shaft 114 may also be integral with the lower plate 106 or welded to the bottom plate 106 as described herein. The shaft 114 also includes a handle 120 for rotating the threaded shaft 114 at its tail end 122. The apparatus 100 also includes a locking member 124 having a nut 126 and wings 128. The apparatus 100 is designed to be inserted into a top end 130 of a leg sleeve 132 of a roof 134 of a floating roof storage tank. The apparatus 100 is inserted into the leg sleeve 132 so that the compressible member 102 is disposed below leg pin apertures 136 in the leg sleeve 132 and the seal is formed below the leg pin apertures 136.

When the handle 120 is turned one way, the plates 104 and 106 move apart permitting the compressible member 102 to relax so that the apparatus 100 can be removed from the sleeve 132. When the handle 120 is turned the other way, the plates 104 and 106 move closer together compressing the compressible member 102 to form a vapor tight or substantially vapor tight seal of the member 102 against an inner surface 138 of the sleeve 132 below the leg pin apertures 136 reducing or eliminating VOC emissions from the sleeves 132.

Figure 2A:
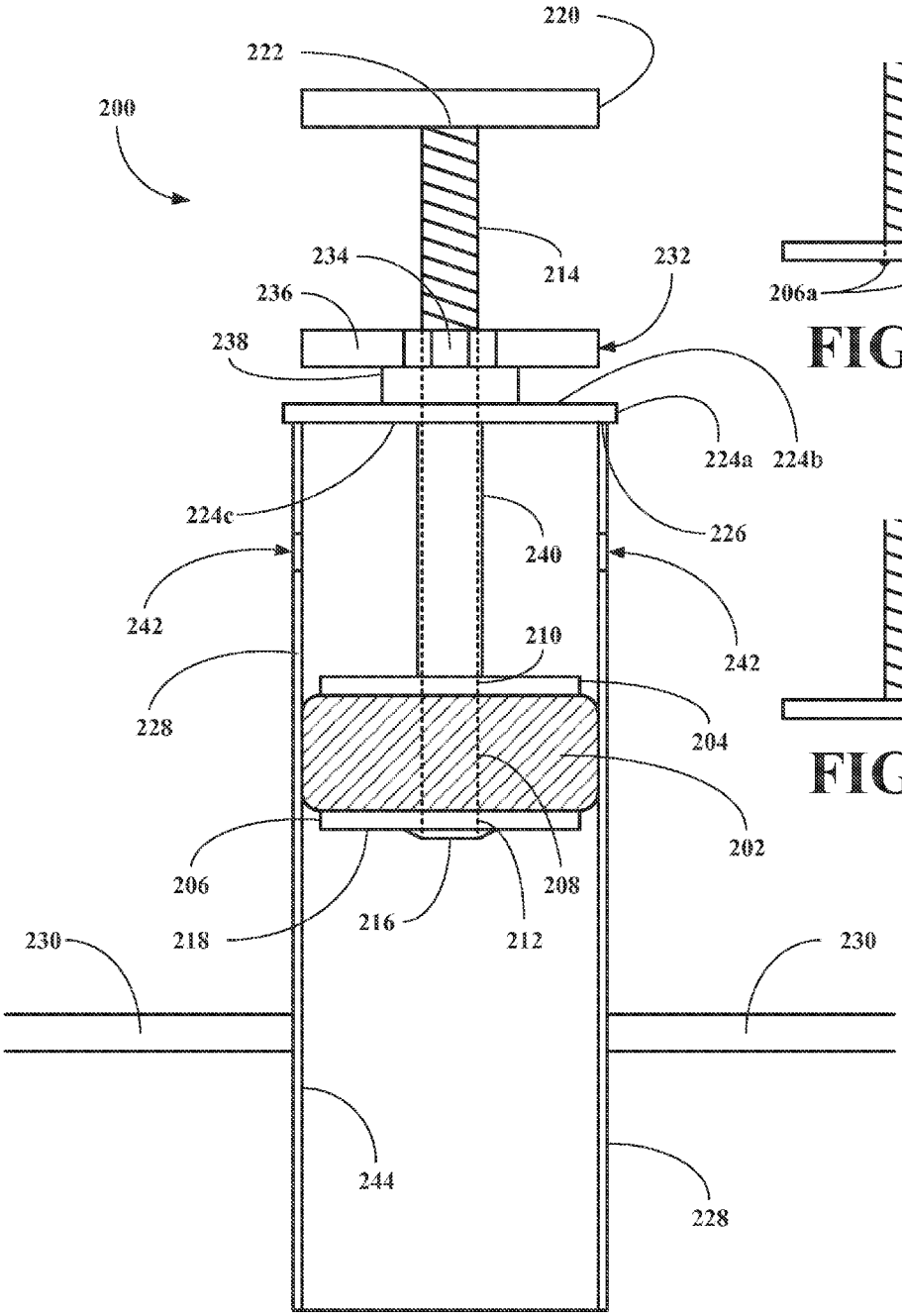
FIGS. 2A-C depict other embodiments of vapor emission control apparatus of this invention.
Figure 2C:
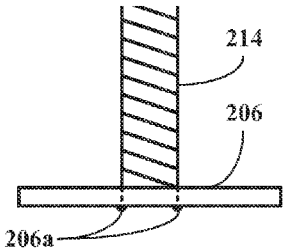
Figure 2B:
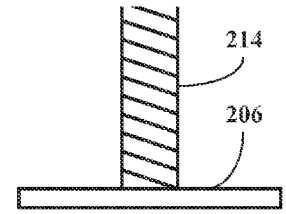

Referring now to FIG. 2A, another embodiment of a vapor emission control apparatus for leg sleeves of a floating roof storage tank, generally 200, is shown to include a compressible member 202 interposed between a top compression plate 204 and a bottom compression plate 206. The compression member 202 includes an aperture 208 therethrough; the top plate 204 includes an aperture 210, therethrough; and the bottom plate 206 includes an aperture 212, therethrough. The three apertures 208, 210, and 212 are designed to align. The apparatus 200 includes a threaded shaft 214 inserted through the apertures 208, 210, and 212 in the member 202 and the plates 204 and 206, respectively. The shaft 214 includes a head end 216 designed to engage a bottom surface 218 of the bottom plate 206. Of course, the shaft 214 may also be integral with the lower plate 206 as shown in FIG. 2B or the head end 216 of the shaft 214 may be welded to the bottom plate 206 by a weld 206*a*. The shaft 214 also includes a handle 220 for rotating the threaded shaft 214 at its tail end 222. The apparatus 200 also includes a top 224*a* having a top surface 224*b* and a bottom surface 224*c*. The top 224*a* is designed to rest on a top end 226 of a leg sleeve 228 of a roof 230 of a floating roof storage tank. The apparatus 200 also includes a locking member 232 having a nut 234 and wings 236. The apparatus 200 also includes a spacer 238 interposed between the top 224*a* and the locking member 232. The apparatus 200 also includes a spacer tube 240 interposed between the top 224*a* and the top plate 204. The apparatus 200 is inserted into the leg sleeve 228 so that the compressible member 202 is disposed below leg pin apertures 242 in the leg sleeve 228 and the seal is formed below the leg pin apertures 242.

When the handle 220 is turned one way, the plates 204 and 206 move apart permitting the compressible member 202 to relax so that the apparatus 200 can be removed from the sleeve 228. When the handle 220 is turned the other way, the plates 204 and 206 move closer together compressing the compressible member 202 to form a vapor tight or substantially vapor tight seal against an inner surface 244 of the leg sleeve 228 below the leg pin apertures 242 reducing or eliminating VOC emissions from the sleeves 228.

Figure 3:
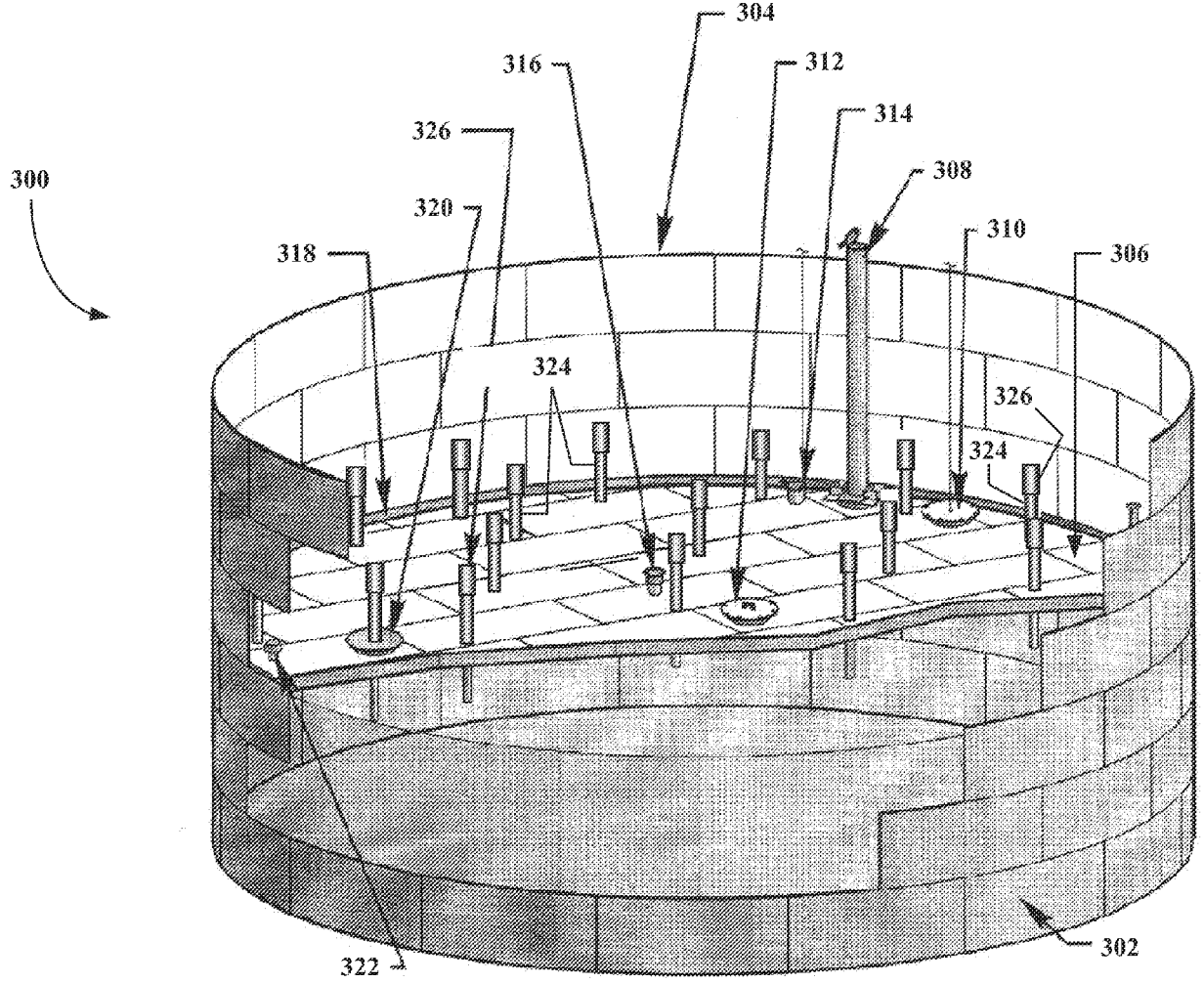
FIG. 3 depicts a perspective view of an open floating roof storage tank equipped with the vapor emission control apparatuses of FIGS. 1, 2A, 2B, and 2C.

Referring now to FIG. 3, an embodiment of an open floating roof storage tank, generally 300, is shown to include a tank shell 302 having a open top 304 and a floating roof 306. The floating roof 306 includes a solid guidepost 308, a gauge float 310, an access hatch 312, gauge hatch or sample port 314 and an overflow drain 316. The floating roof 306 further includes a rim seal 318, a vacuum breaker 320 and a rim vent 322. The floating roof 306 also includes a plurality of leg sleeves 324 equipped with the vapor emission control apparatuses 326 of FIGS. 1-2D.

Figure 4:
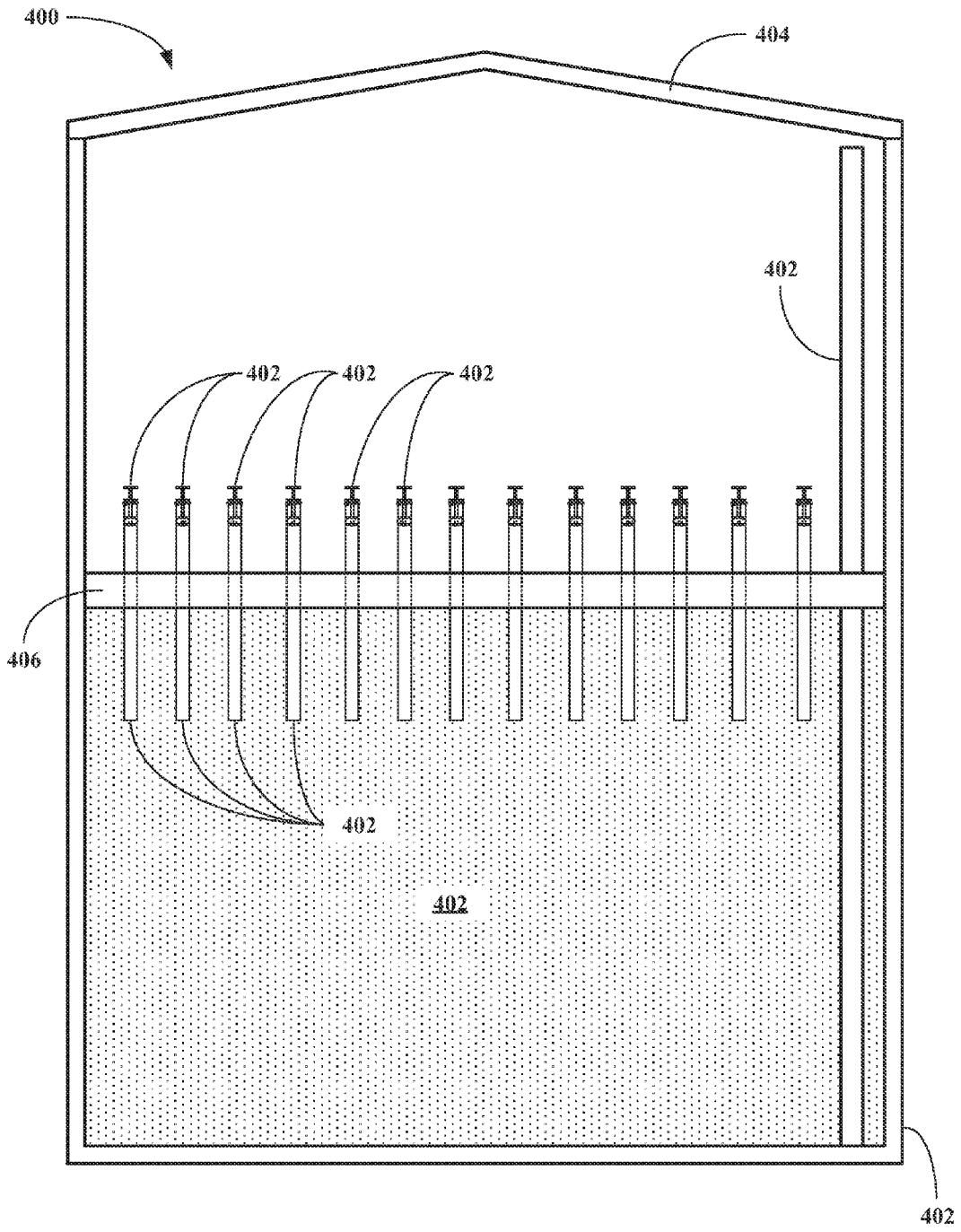
FIG. 4 depicts a plan view of an internal floating roof storage tank equipped with the vapor emission control apparatuses of FIGS. 1, 2A, 2B, and 2C.

Referring now to FIG. 4, an embodiment of a closed floating roof storage tank, generally 400, is shown to include a tank shell 402 having a top 404 and a floating roof 406. The tank 400 also includes a guide post 408 as in the tank 200 of FIG. 2. The roof 306 includes a plurality of deck leg sleeves 410 equipped with an equal plurality of the vapor emission control apparatus 412. Of course, the tank 400 includes some or all of the other features of the tank 300 of FIG. 3.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. An emission controlled floating roof storage tank apparatus comprising:
- a floating roof including:
  - a plurality of leg sleeves distributed in the floating roof of the tank,
  - a side or sides, and
  - a bottom, and
- a vapor emission control system including:
  - a plurality of vapor emission control apparatuses, each vapor emission control apparatus comprises:
    - a top compression plate including an top plate aperture therethrough,
    - a bottom compression plate including a bottom plate aperture therethrough,
    - a compressible member interposed therebetween and including a compressible member aperture therethrough, and
    - a compression assembly for compressing the compressible member,
- where each sleeve includes a vapor emission control apparatus inserted into a top of each sleeve and the compression assembly compresses the compressible member to produce a gas tight seal between the compressible member and an inner surface of each sleeve when the tank is in service and where the compression assembly decompresses the compressible member, when the vapor emission control apparatuses need to be removed from the sleeves and
- where the vapor emission control system reduces, substantially eliminates or completely eliminates volatile organic compound (VOC) emissions from the tank through the leg sleeves.

2. The apparatus of claim 1, wherein the compression assembly comprises:
- a threaded shaft inserted through the member and the plates and including
  - a head end for engaging a bottoms surface of the bottom plate, and tail end including a handle for rotating the threaded shaft.

3. The apparatus of claim 1, wherein each vapor emission control apparatus further includes:
- a top designed to rest on a top end of each leg sleeve, and
- a locking assembly for locking the shaft.

4. The apparatus of claim 3, wherein the locking assembly comprises:
- a nut having wings.

5. The apparatus of claim 1, wherein each vapor emission control apparatus further includes:
- a spacer interposed between the top and the locking member.

6. A vapor emission control system comprising:
- a plurality of vapor emission control apparatuses, each vapor emission control apparatus comprises:
  - a top compression plate including an top plate aperture therethrough,
  - a bottom compression plate including a bottom plate aperture therethrough,
  - a compressible member interposed therebetween and including a compressible member aperture therethrough, and
  - a compression assembly for compressing the compressible member,
- where each sleeve includes a vapor emission control apparatus inserted into a top of each sleeve and the compression assembly compresses the compressible member to produce a gas tight seal between the compressible member and an inner surface of each sleeve when the tank is in service and where the compression assembly decompresses the compressible member, when the vapor emission control apparatuses need to be removed from the sleeves and
- where the vapor emission control system reduces, substantially eliminates or completely eliminates volatile organic compound (VOC) emissions from the tank through the leg sleeves.

7. The system of claim 6, wherein the compression assembly comprises:
- a threaded shaft inserted through the member and the plates and including a head end for engaging a bottoms surface of the bottom plate, and tail end including a handle for rotating the threaded shaft.

8. The system of claim 6, wherein each vapor emission control apparatus further includes:

a top designed to rest on a top end of each leg sleeve, and a locking assembly for locking the shaft.

9. The system of claim 8, wherein the locking assembly comprises:

a nut having wings.

10. The system of claim 6, wherein each vapor emission control apparatus further includes:

a spacer interposed between the top and the locking member.

11. A method for reducing emission from a floating roof storage tank comprising:

inserting a vapor emission control apparatus into a top of each of a plurality of leg sleeves of the floating roof storage tank, where the vapor emission control apparatuses comprise:

a top compression plate including an top plate aperture therethrough, a bottom compression plate including a bottom plate aperture therethrough, a compressible member interposed therebetween and including a compressible member aperture therethrough, and a compression assembly for compressing the compressible member, and compressing the compressible member via the compression assembly to produce a gas tight seal between the compressible member and an inner surface of each sleeve when the tank is in service, where the vapor emission control apparatuses reduce, substantially eliminate, or completely eliminate volatile organic compound (VOC) emissions from the tank through the leg sleeves.

12. The method of claim 11, further comprising:

decompressing the compressible member via the compression assembly so that the vapor emission control apparatuses may be removed from the sleeves.

13. The method of claim 11, wherein the compression assembly comprises:

a threaded shaft inserted through the member and the plates and including a head end for engaging a bottoms surface of the bottom plate, and tail end including a handle for rotating the threaded shaft.

14. The method of claim 11, wherein each vapor emission control apparatus further includes:

a vapor emission control apparatus top designed to rest on a top end of each leg sleeve, and a locking assembly for locking the shaft.

15. The method of claim 14, wherein the locking assembly comprises:

a nut having wings.

16. The method of claim 14, wherein each vapor emission control apparatus further includes:

a spacer interposed between the vapor emission control apparatus top and the locking assembly.

* * * * *